US006109154A

United States Patent [19]

Miyatsu et al.

[11] Patent Number: 6,109,154

[45] Date of Patent: Aug. 29, 2000

[54] SHEET-CUTTER HAVING MOTOR DRIVEN PUSH CUTTER

[75] Inventors: Keiji Miyatsu, Nagano; Yukihiro Mori, Iiyama; Masami Ishizawa, Nagano, all of Japan

[73] Assignee: Fujitsu Takamisawa Component Limited, Tokyo, Japan

[21] Appl. No.: 08/917,890

[22] Filed: Aug. 26, 1997

[30] Foreign Application Priority Data

Mar. 18, 1997 [JP] Japan ..... 9-064380

[51] Int. Cl.[7] ..... B26D 5/08; B26D 5/14

[52] U.S. Cl. ..... 83/627; 83/629; 83/631; 83/636; 83/821; 83/694; 83/856; 83/697; 83/695; 83/202

[58] Field of Search ..... 83/563, 566, 616, 83/624, 626, 628, 629, 627, 631, 636, 821, 694, 856, 697, 602, 603, 695, 660, 202, 203

[56] References Cited

U.S. PATENT DOCUMENTS

| | | | |
|---|---|---|---|
| 3,240,094 | 3/1966 | Endert | 83/636 |
| 4,244,255 | 1/1981 | Dykstra | 83/631 X |
| 4,881,459 | 11/1989 | Ramun | 83/636 X |
| 4,936,177 | 6/1990 | Ozawa et al. | 83/628 X |
| 5,088,370 | 2/1992 | Kondo | 83/628 X |
| 5,090,285 | 2/1992 | Knodo | 83/628 X |
| 5,235,887 | 8/1993 | Moriya | 83/628 X |
| 5,584,218 | 12/1996 | Schoendienst | 83/636 |

*Primary Examiner*—Rinaldi I. Rada
*Assistant Examiner*—Boyer Ashley
*Attorney, Agent, or Firm*—Staas & Halsey LLP

[57] ABSTRACT

A sheet cutter cuts a portion of a continuous sheet, discharged through a gap between a pair of moving and stationary knives respectively having arc-shaped and straight knife edges. A motor rotates a pair of rotatable, identical gear wheels engaged with each other and opposed to the moving knife and having a pair of respective link arms thereon. Each link arm has a first end connected to a peripheral position of the respective gear wheel by a pivot thereon and a second end connected to the moving knife by a pin inserted into a respective one of a pair of horizontally extending slits in the moving knife. Rotating motion of the gear wheels is transformed into a reciprocating motion of the moving knife against, and relatively to, the stationary knife, in which the second end of each link arm assumes one of two opposing positions, depending respectively upon a current one of opposite rotating directions of the respective gear wheel, such that one or the other rotating direction of the motor results in the reciprocating motion of the moving knife with a stroke either to cut the sheet completely or incompletely.

33 Claims, 11 Drawing Sheets

SHEET-CUTTER HAVING MOTOR DRIVEN PUSH CUTTER

BACKGROUND OF THE INVENTION

1. Field of the Invention

This invention relates to a sheet cutter for cutting a sheet, particularly to one having a motor driven push cutter for cutting a portion of a continuous sheet discharged from a printer such as for hand held electric appliances.

2. Description of the Related Art

A role of paper used in a printer of some hand held electric appliances, such as a terminal register used in restaurants, is required to be cut bilaterally, namely, sometimes a printed part of the paper is cut off completely as a receipt for a customer and at other times a plurality of printed parts are cut incompletely between the successive printed parts as a series of receipts for a group of respective customers, the plurality of printed parts remaining connected by a central uncut part of narrow width. Each of the printed parts can be easily separated from each other by hand later on if every customer wants to have his. The former is often call full cut and the latter, half cut.

FIG. 1 is an exploded view of a main part of a prior art sheet cutter, and FIG. 2 is a front view of the main part of the prior art sheet cutter, which is looked at along an arrow indicated by a letter A. The sheet cutter 1 comprises a driving unit, or member, 11 mounted on a side wall of a chassis 1*a,* a rotating disc 12 assembled in the driving unit 11, a moving knife unit 13 making a moving knife 131 moved upwardly and downwardly by mounting both on the side wall of the chassis 1*a* and the rotating disc 12, and a stationary cutter unit 14 having a stationary knife 141 on it opposed to the moving knife 131. The driving unit 11 further includes a gear wheel 111 freely rotatable around a pivot P (i.e., an axle, or a shaft) mounted on a side wall of the chassis 1*a,* a worm gear 115 engaging with the gear wheel 111, and a driving motor 114 mounted on the side wall of the chassis 1*a,* a drive shaft of which is directly connected with an axle (i.e., a shaft) of the worm gear 115. Both a rotation pivot (i.e., shaft) 112, for the rotating disc 12, and a first sliding pin 113, restricting an angle of rotation of the rotating disc 12, are formed on respective peripheral positions of the gear wheel 111, projecting from an exposed side of the gear wheel 111. The rotating disc 12, having nearly the same diameter as that of the gear wheel 111, has a pivot bore 12*a* penetrated by the pivot 112 and an arcuate slit 12*b* for receiving therein and allowing the first sliding pin 113 to move therein, and which limits the angle of rotation of the rotating disc 12, and a second sliding pin 12*c* projecting from the exposed side of the gear wheel 111 into an elongated slot, or base, 123*b* of link arm 132 and which propagates driving forces to the moving knife unit 13. Thus, the rotating disc 12 is rotatable within the limited angle defined by the arcuate slit 12*b,* relatively to the gear wheel 111, when the rotating disc 12 is mounted on the gear wheel 111 by engaging the pivot 112 with the pivot bore 12*a* and the first sliding pin 113 with the slit 12*b.* The moving knife unit 13 comprises a moving knife 131 and the above-noted link arm 132, jointed with each other. The moving knife 131 has a vertical arm 131*d* on the upper side, an angle knife 131*b* with a setback area of a square notch 131*a* at the central region S on the lower side, and a pair of legs 131*c*. The link arm 132 has a pivot bore 132*a* on a first end engaged with a pivot 1*a'* protruding from the side wall of the chassis 1*a* and a long bore 132*b* engaged with the second sliding pin 12*c* of the rotating disc 12 on a second end. The link arm 132 is jointed with the moving knife 131 by a pin 132*c* (FIG. 2) at the upper end of the vertical arm 131*d* such that the link arm 132 is rotated around the pin 132*c* in a plane.

The stationary knife unit 14 comprises a knife stage 142 and a stationary knife 141 mounted on the knife stage 142, in which the stationary knife 141 is arranged in the foreground relative to the moving knife 131 in FIG. 1. The knife stage 142 has a narrow groove 142*a* into which the moving knife 131 is inserted. The narrow groove 142*a* has a pair of guiding portions 142*b* on both ends, which guide the respective legs 131*c*. A printed portion of continuous paper 15 is discharged through a gap between knife edges of the moving and stationary knives in the foreground direction indicated by a letter B.

FIGS. 3 and 4 are front views of the main part of a sheet cutter of a first prior art device, to explain full-cut and half-cut operations, respectively. In FIG. 3, the gear wheel 111 rotates clockwise about its axis, or pivot, P as indicated by a letter $B_1$ by the normal rotation of the motor 114, which causes a pivotal motion of the rotating disc 12 in the direction of an arrow as indicated by a letter $C_1$ by reactions from the first sliding pin 113 to the slit 12*b* and from the long bore 132*b* to the second sliding pin 12*c*. The reverse rotation of the motor 114 causes a counter clockwise rotation of the gear wheel 111 as indicated by a letter $B_2$ and then a pivotal motion of the rotating disc 12 in the direction of an arrow as indicated by a letter $C_2$ as shown in FIG. 4. Since a clockwise rotating radius $R_1$ of the rotating disc 12 is larger than a counter clockwise rotating radius $R_2$, a down stroke of the moving knife 131 for clockwise rotation of the rotating disc 12 is longer than that for counter clockwise rotation of the rotating disc 12. The longer stroke of the moving knife 131 cuts off the discharged portion of continuous paper completely, while the shorter stroke cuts it incompletely by stopping the moving knife 131 such that the setback area of a square notch 131*a* at the central region on the lower side of the moving knife 131 shown in FIG. 1 is maintained above the upper surface of the paper. Therefore, the full-cut and half-cut of the paper can be carried out by selecting the normal and reverse rotations of the motor 114, respectively.

FIG. 5 is a front view of the main part of a prior art sheet cutter to explain a first drawback. The first drawback of the prior art is the fact that since the link arm 132 jointed with the moving knife 131 by the pin 132*c* is pivoted at 132*a,* a total force applied to the pin 132*c* denoted by a letter $F_1$ has a horizontal component of force when the moving knife 131 is pushed down. Therefore, the horizontal component of force causes an angular momentum in a plane including the moving knife which eventually often hinders the moving knife from moving down smoothly.

FIG. 6 is a front view of the main part of a prior art sheet cutter to explain a second drawback. The second drawback of the prior art is the fact that since the square notch 131*a* having a width denoted by a letter b at the central region on the lower side of the moving knife 131 has no sharp knife edge, a cross-section of the paper is not as sharply-cut in the fall-cut operation, wherein the cutting portion at the central region is protruded by a length corresponding to thickness of the knife edge denoted by a letter t from the other cutting portions in both sides 15*a* of the paper 15, and wherein, in the half-cut operation, the uncut portion having width 15*b* causes an irregular cutting shape when it is torn off by hand, which is not favorable in appearance.

SUMMARY OF THE INVENTION

An object of the present invention is to provide a sheet cutter including a pair of moving and stationary knives, in which the moving knife can move against a stationary knife smoothly along a pair of parallel cutter guides by pushing downwardly or pulling upwardly at two symmetrical points with the identical forces in parallel to the cutter guides, such that a total angular momentum on the moving knife around a gravitational center thereof vanishes (i.e., is nil).

Another object of the present invention is to provide a sheet cutter including a pair of moving and stationary knives, in which the moving knife has a thinner knife edge in the central part compared to the rest thereof, such that a cross-section of cut-off paper is smooth and clear-cut when the paper is cut off completely.

BRIEF DESCRIPTION OF THE DRAWINGS

The present invention will be more apparent from the following description, when taken to conjunction with the accompanying drawings, in which.

DESCRIPTION OF THE PREFERRED EMBODIMENTS

Reference will now be made in detail to the preferred illustrated embodiments of the invention, examples of which are illustrated in the accompanying drawings. While the invention will be described in conjunction with the preferred illustrated embodiments, it will be understood that they are not intended to limit the invention to these embodiments. On the contrary, the invention is intended to cover alternatives, modifications and equivalents, which may be included within the spirit and scope of the invention as defined by the appended claims.

Common reference numbers and symbols are used throughout figures below whenever mechanical parts or functions are same.

Figure 7:
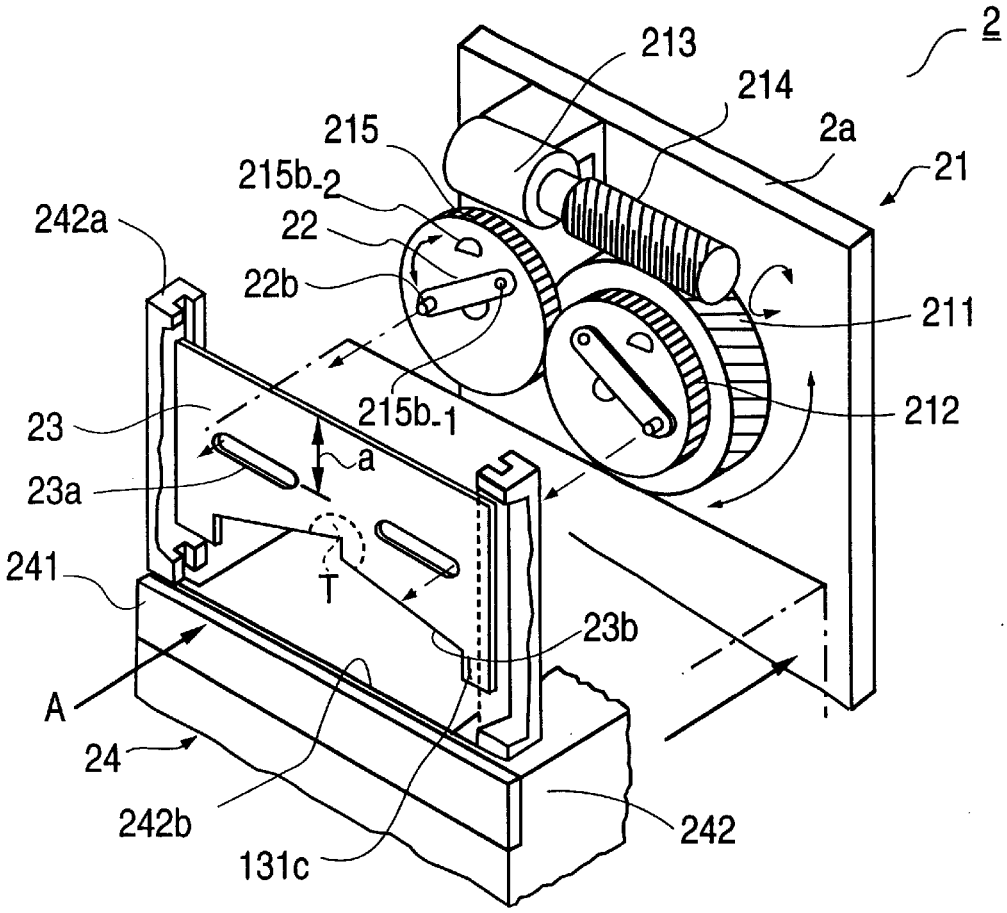
FIG. 7 is an exploded, perspective view of a main part of a sheet cutter of a first embodiment according to the present invention.
Figure 8:
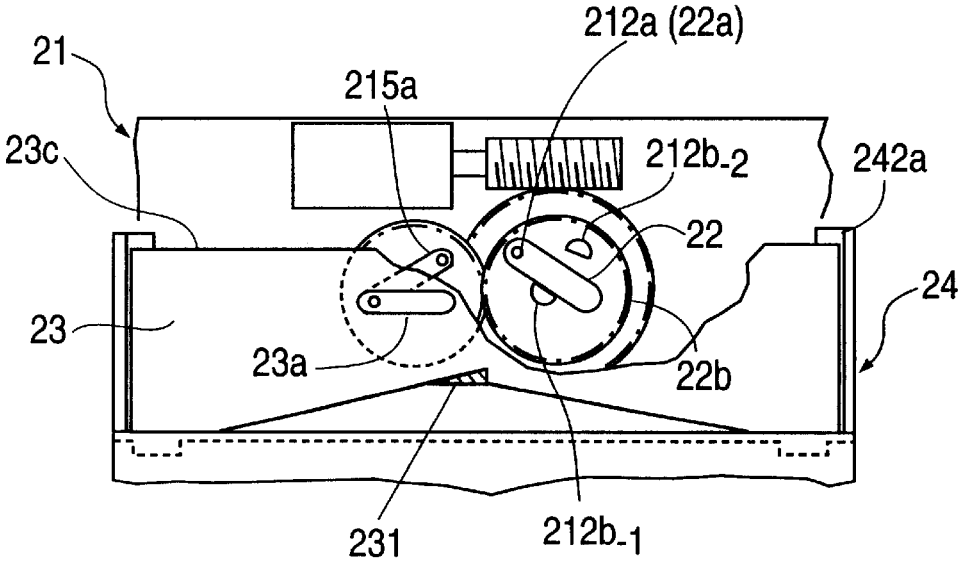
FIG. 8 is a front view of the main part of the sheet cutter shown in FIG. 7 according to the present invention.

FIGS. 7 and 8 are an exploded, perspective view and a front view, respectively, of the main part of a sheet cutter of a first embodiment according to the present invention, in which FIG. 8 is viewed in the direction of an arrow denoted by a letter A shown in FIG. 7.

A sheet cutter 2 shown in FIG. 7 comprises a driving unit 21 mounted on a side wall of the chassis 2*a,* a pair of link arms 22 connected with the respective gear wheels 211, 215 (described later) which are components of the driving unit 21, a moving knife 23 connecting with the link arms 22, and a cutter unit 24. The cutter unit 24 comprises a stage 242 having a pair of parallel guides 242*a* for guiding the moving knife 23 to slide upwardly or downwardly, a stationary knife 241 opposing to the moving knife 23, and a narrow groove 242*b* for receiving the pair of legs 131*c* of the moving knife 23. The driving unit 21 comprises a driving motor 213 secured to the side wall of the chassis 2*a* with a shaft extending parallel to the side wall having a worm gear 214 on an end portion of, and so as to rotate with, the shaft, a worm gear 211 with a shaft attached to the side wall rotated by engaging with the worm gear 214, and a pair of identical gear wheels 212 and 215 engaged with each other, the first one 212 being fixed to the worm gear 211 with the same axis (i.e., shaft) as that of the worm gear 211 and the second one 215 being rotatable in the same plane as that of the first one 212 with a shaft attached to the side wall. The first and second gear wheels 212, 215 have respective pivots 212*a,* 215*a* and respective pairs of stoppers $\mathbf{212}b_{-1}$, $\mathbf{212}b_{-2}$, and $\mathbf{215}b_{-1}$, $\mathbf{215}b_{-2}$ projecting out of the exposed sides of the gear wheels, respectively. Each of the link arms 22 has a through hole at one end into which the respective one of the pivots 212*a,* 215*a* is inserted. The pivots 212*a* and 215*a* are located in the neighborhood of the respective periphery of the gear wheels 215 and 215, respectively. Each pair of the stoppers $\mathbf{212}b_{-1}$, $\mathbf{212}b_{-2}$ and $\mathbf{215}b_{-1}$, $\mathbf{215}b_{-2}$ limits the respective rotating angle of the link arms 22, respectively. The stoppers $\mathbf{212}b_{-1}$, and $\mathbf{215}b_{-1}$ are located in the neighborhood of the respective centers of the gear wheels 212 and 215, respectively, while the stoppers $\mathbf{212}b_{-2}$ and $\mathbf{215}b_{-2}$ are located in the neighborhood of the respective peripheries of the gear wheels 212 and 215, respectively. Each of the link arms 22 15 is connected at a first end to, and is rotatable around, the respective one of the pivots 212*a,* 215*a,* and has a pin 22*b* projecting out of the exposed side at the second end of each thereof, which is inserted into the respective one of a pair of horizontally extended slits 23*a* in the moving knife 23. The horizontally extended slits 23*a* in the moving knife 23 are located symmetrically to each other with respect to the vertical axis passing through the gravitational center of the moving knife 23, below the upper side 23*c* (FIGS. 7 and 8) of the moving knife 23 by a distance denoted by a letter a (FIG. 7), and having an identical length on both sides, which is long enough to cover the horizontal maximum moving range of the pins corresponding to the overall range of the limited rotating angle. In this configuration, when the motor 213 drives the worm 214, rotation of the worm 214 causes a normal (i.e., forward) rotation of the gear wheel 212 and the reverse rotation of the gear wheel 212 through the worm gear 211. Rotation of both the gear wheels gives rise to sliding both pins 22*b* along the horizontally extended slits 23*a* on the moving knife 23, symmetrically to each other with respect to the vertical axis passing through the gravitational center of the moving knife 23. Consequently, the symmetrical horizontal motion of both pins 22*b* makes the moving knife 23 move upwardly or downwardly, depending upon a rotating direction of the motor 213. It should be noted that since the pins move symmetrically to each other, the moving knife 23 moves upwardly or downwardly smoothly along the pair of parallel guides 242*a*. This is because the horizontal components of the forces exerted on the slits 23*a* by the respective pins always cancel out each other, and only the vertical components of the forces are exerted on the slits in parallel to the pair of guides 242*a*. In other words, there is no net angular momentum around the gravitational center of the moving knife during vertical movements of the moving knife. Thus, this structural feature results in smooth vertical movements of the moving knife.

Another structural feature according the present invention are that the moving knife 23 has an asymmetric knife edge 23*b* which consists of two knife edges, both inclined relatively to the stationary knife edge 241, and that one knife edge is slightly longer than the other. Since this knife edge has a setback area of a triangular shape 231 in the central region (shown in FIG. 8 as a shaded area) and which is inclined relatively to the stationary knife edge 241, the uncut region 15*b* of the paper for the half-cut can be left with a larger allowable error in the stroke of the moving knife than that of the moving knife having no setback area, such as a simple inverse V-shape knife edge, and that the whole paper can be cut off with a clear-cut cross-section for the full-cut.

Figure 1:
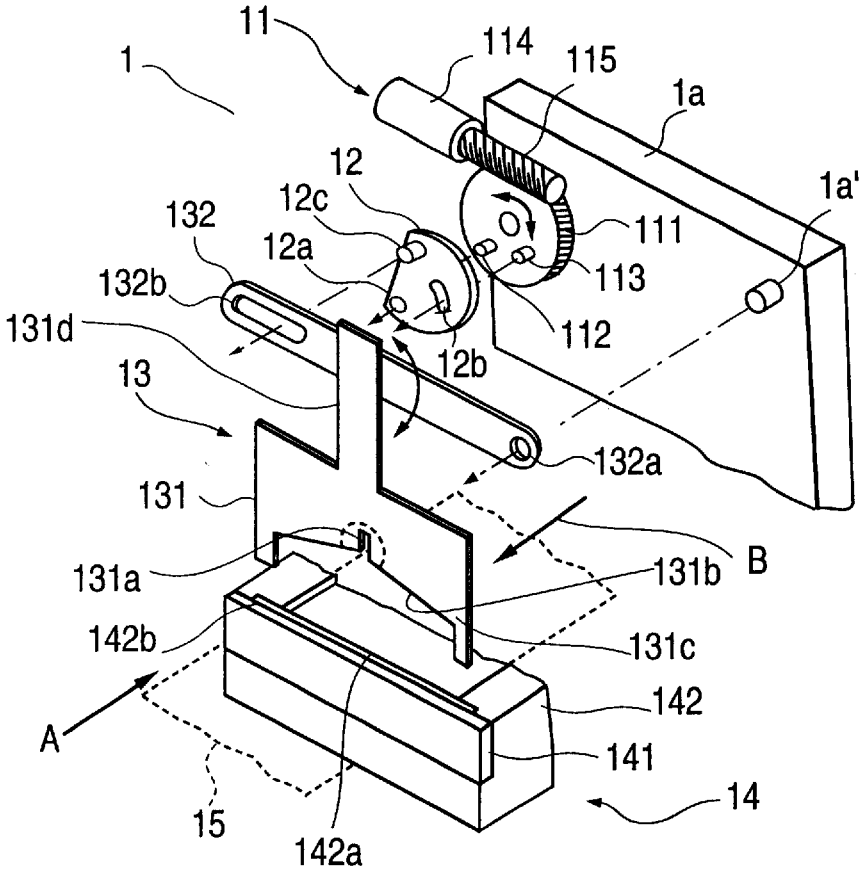
FIG. 1 (PRIOR ART)
FIG. 1 is an exploded view of the main part of a prior art sheet cutter.
Figure 2:
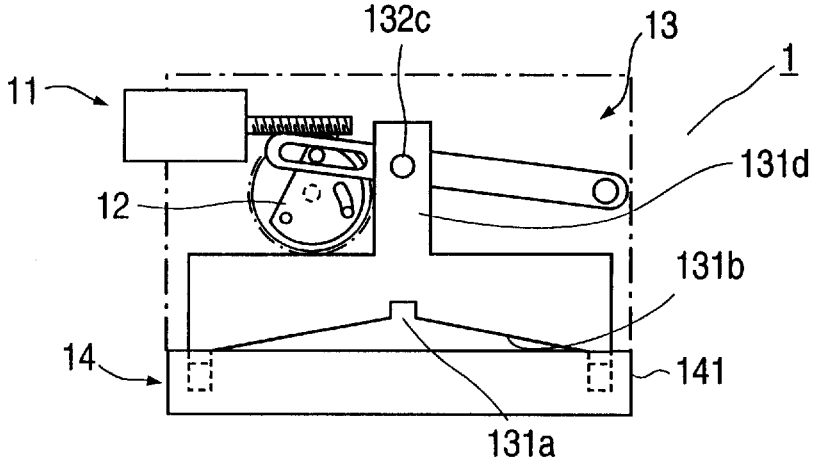
FIG. 2 (PRIOR ART)
FIG. 2 is a front view of the main part of the prior art sheet cutter.
Figure 3:
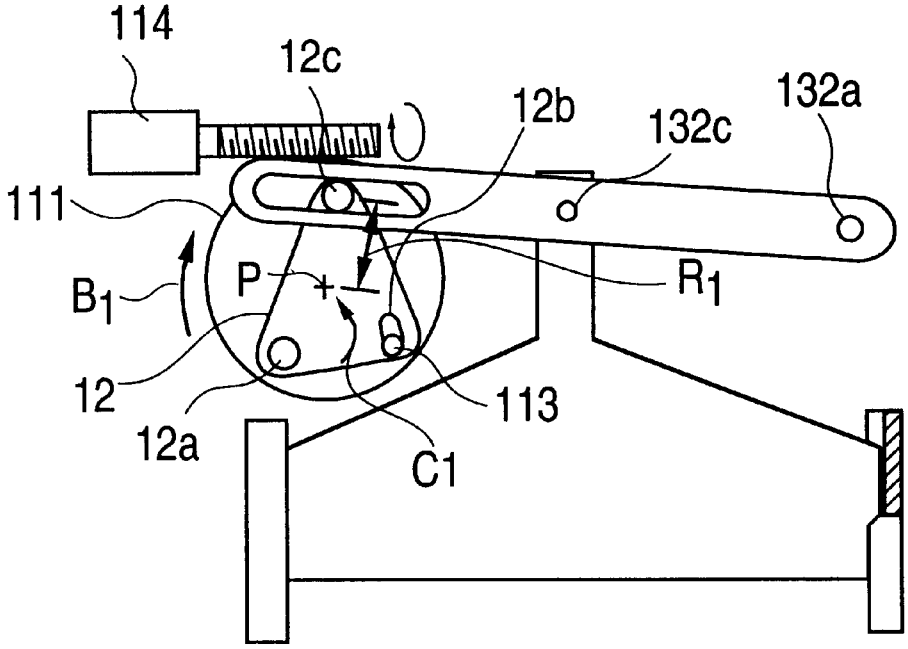
FIG. 3 (PRIOR ART)
FIG. 3 is a front view of the main part of a prior art sheet cutter to explain a full-cut operation.
Figure 4:
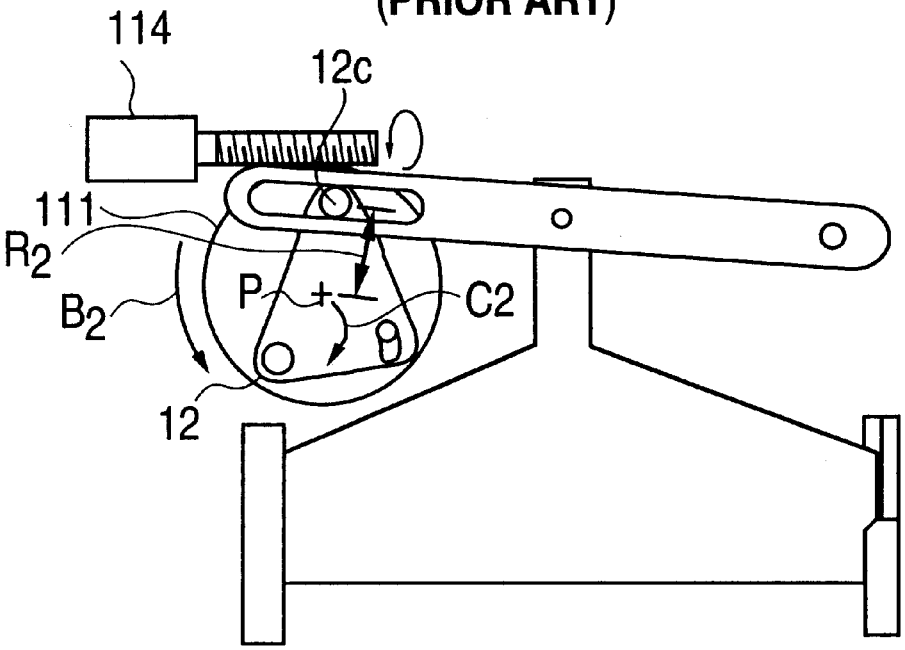
FIG. 4 (PRIOR ART)
FIG. 4 is a front view of the main part of a prior art sheet cutter to explain a half-cut operation.
Figure 5:
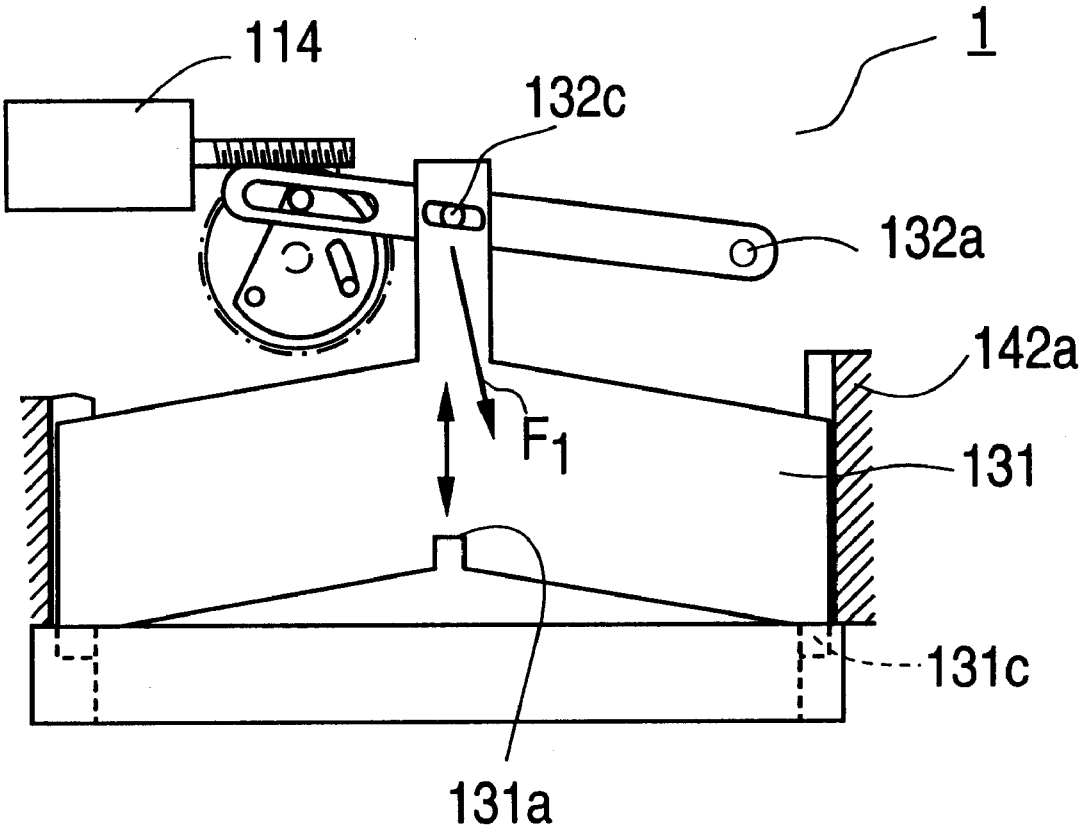
FIG. 5 (PRIOR ART)
FIG. 5 is a front view of the main part of a prior art sheet cutter to explain the first drawback.
Figure 6:
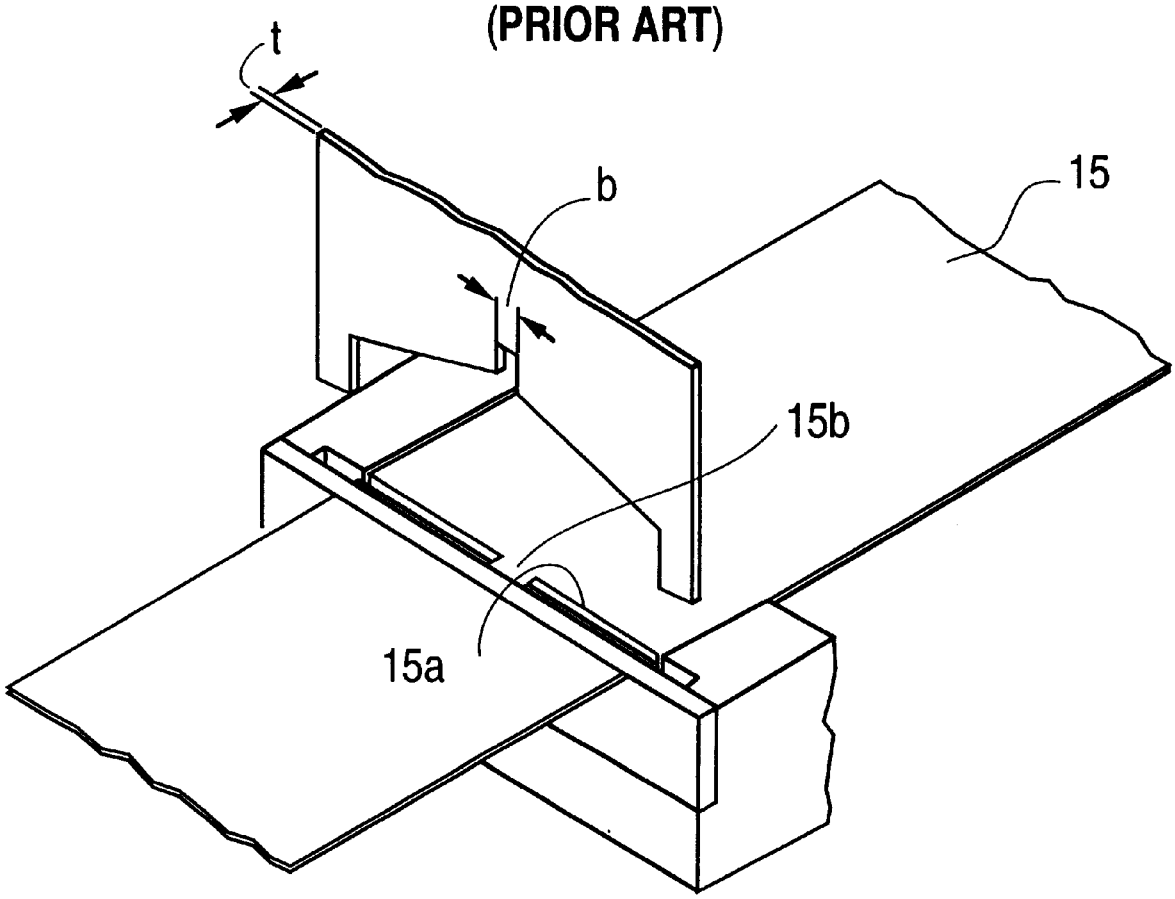
FIG. 6 (PRIOR ART)
FIG. 6 is a front view of the main part of a prior art sheet cutter to explain the second drawback.
Figure 20:
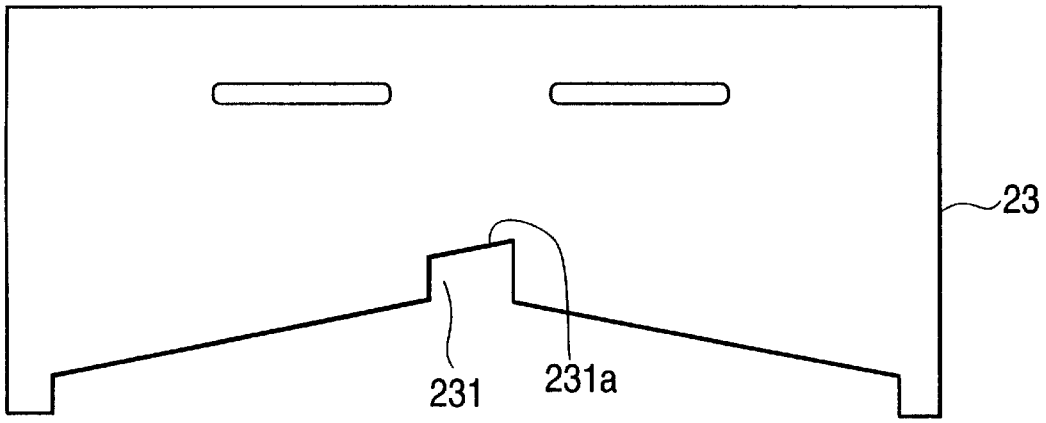
FIGS. 20 and 21 are front view of moving knives having setback areas of various shapes according to the present invention.
Figure 21:
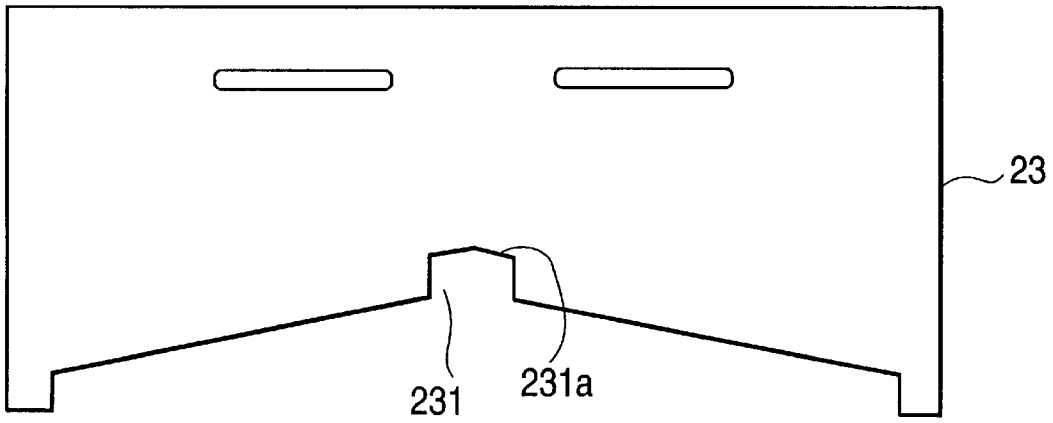

The inclined knife edge in the setback area gives another favorable effect, in that the uncut region 15*b* shown in FIG. 6 can be chosen to be any desired width by adjusting the stroke of the moving knife, which can leave a better shape of a rupture pattern by narrowing the width of the uncut region 15*b* as desired for the half-cut when the uncut region 15*b* is torn by hand. The setback area 231 according to the present invention generally has an inclined upper side 231*a*. FIGS. 20 and 21 are some modified cases for the setback area. Either one can pronounce the beneficial effects similar to the moving knife shown in FIG. 8.

Figure 9:
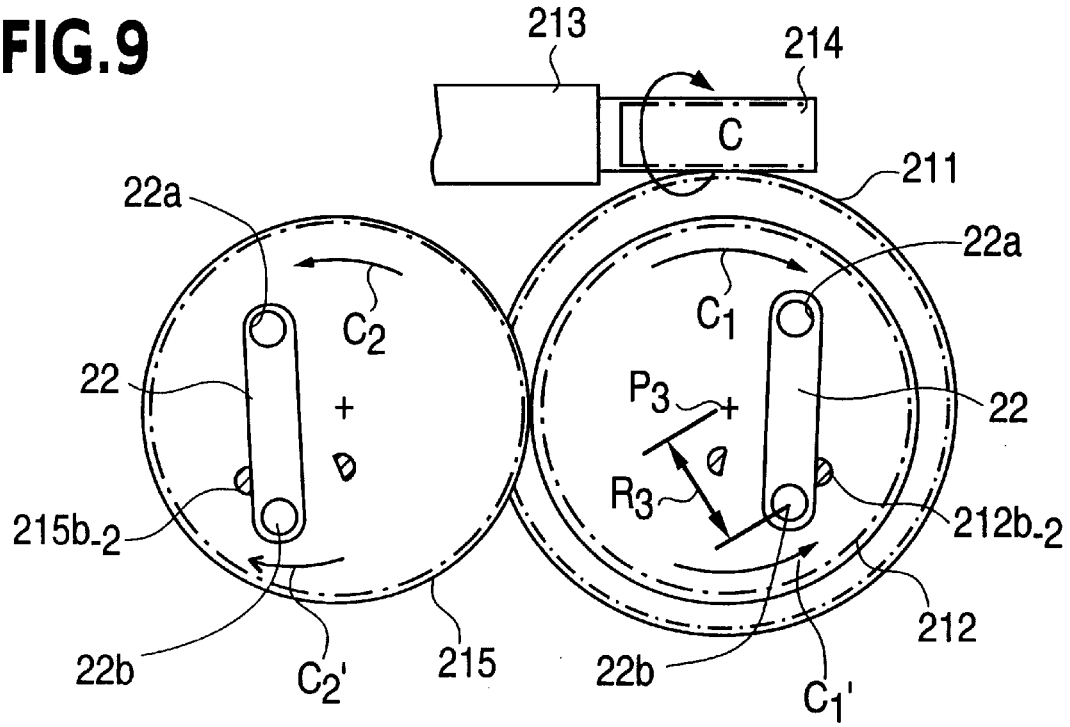
FIG. 9 is a front view of the main part of the sheet cutter shown in FIG. 7 to explain a full-cut operation.
Figure 10:
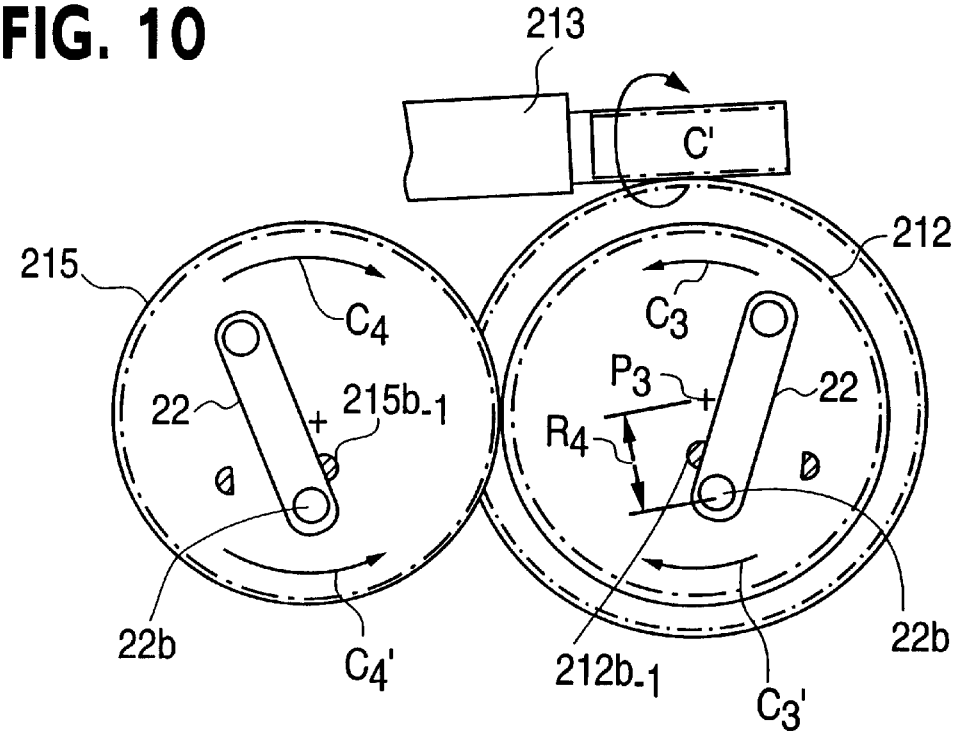
FIG. 10 is a front view of the main part of the sheet cutter shown in FIG. 7 to explain a half-cut operation.

FIGS. 9 and 10 are front views of the main part of the sheet cutter shown in FIG. 7 to explain full-cut and half-cut operations, respectively.

In FIG. 9, the motor 213 rotates the worm gear 214 in the direction of an arrow denoted by a letter C, and then rotates both the worm gear 211 about its axis and the first gear wheel 212 clockwise about its axis, or pivot, P3 as indicated by an arrow denoted by a letter $C_1$, which produces an accompanying counter clockwise rotation of the second gear wheel 215 as indicated by an arrow denoted by a letter $C_2$. Eventually, both the link arms 22 rotate in mutually opposite directions indicated by arrows $C_1'$ and $C_2'$, to relatively to each other and to the directions of $C_1$ and $C_2$ of to the first and second gear wheels 212, 215, respectively. Therefore, the first and second gear wheels 212, 215 rotate under conditions that (i.e., to a limit at which) the link arms 22 come into contact with the respective stoppers 212*b*$_{-2}$ and 215*b*$_{-2}$, respectively.

On the other hand and as shown in FIG. 10, when the motor 213 rotates the worm gear 214 together in the direction of an arrow denoted by a letter C' (FIG. 10), the first gear wheel 212 with the worm gear 211 rotate counter clockwise, as indicated by an arrow denoted by a letter $C_3$ and then the second gear wheel 215 rotates clockwise as indicated by an arrow denoted by a letter $C_4$ as shown in FIG. 10. Consequently, the first and second gear wheels 212, 215 rotate about respective thin respective prints P3 in the respective, relatively opposite $C_3'$ and $C_4'$ directions under conditions that (i.e., to a limit at which) the respective link arms 22 contact the respective stoppers 212*b*$_{-1}$ and 215*b*$_{-1}$, respectively. The rotating radii $R_3$, $R_4$ of the link arms 22 are defined by distances between the center of the first gear wheel 212 and the pin 22*b* for the clockwise and counter clockwise rotations of the first gear wheel 212 as shown in FIGS. 9 and 10, respectively, wherein the rotating radius $R_3$ is larger than the rotating radius $R_4$. This is because the stoppers 212*b*$_{-1}$ and 215*b*$_{-1}$ are located in the neighborhood of the respective rotating centers of the first and second gear wheels 212, 215, respectively, while the stoppers 212*b*$_{-2}$ and 215*b*$_{-2}$ are located in the neighborhood of the respective peripheries of the first and second gear wheels 212, 215, respectively. The difference in radius results that the vertical stroke of the moving knife in FIG. 9 is longer than that in FIG. 10. Therefore, it is possible that the longer stroke as shown in FIG. 9 is applied to the full-cut of the paper, and the shorter stroke as shown in FIG. 10 is applied to the half-cut by optimizing the position of the stationary knife against the moving knife. In other words, the full-cut and half-cut operations can be determined by selecting a rotating direction of the motor 213.

Figure 11:
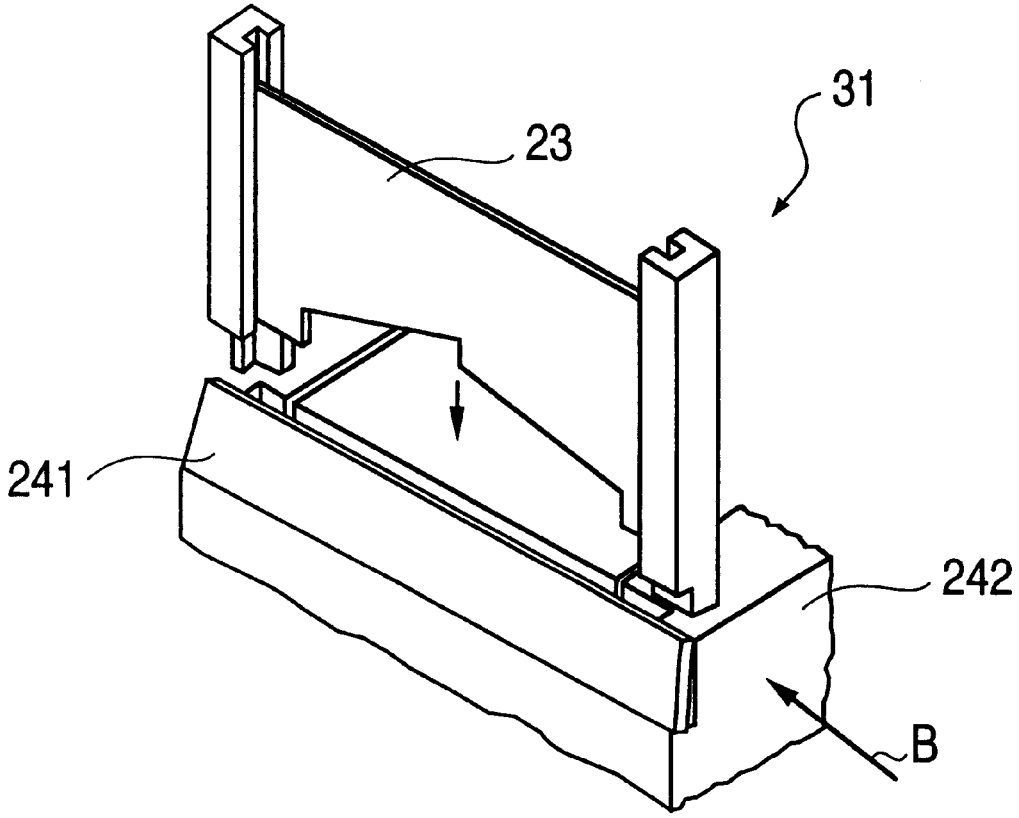
FIG. 11 is a perspective view of a main part of a sheet cutter of a second embodiment according to the present invention.
Figure 12:
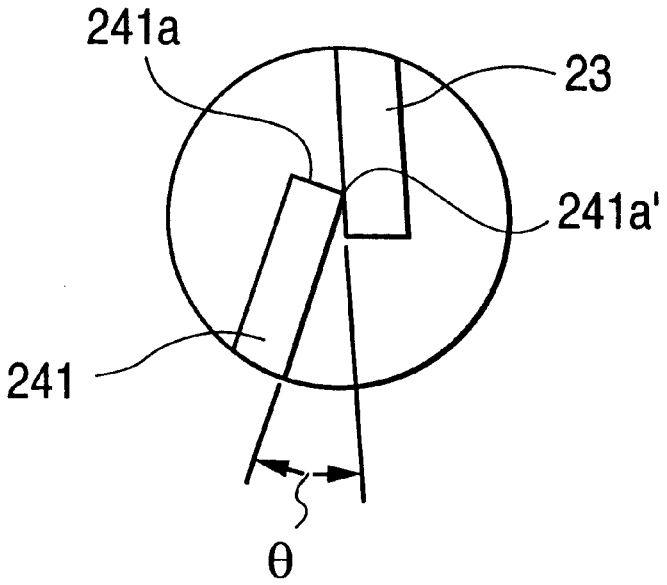
FIG. 12 is an enlarged side view of the moving and stationary knives of the sheet cutter shown in FIG. 11.

FIGS. 11 and 12 are a perspective view of the main part of a sheet cutter for the second embodiment according to the present invention and an enlarged side view of the moving and stationary knives viewed along the direction denoted by a letter B shown in FIG. 11, respectively.

The cutter unit 31 for the second embodiment can be obtained by mounting the stationary knife 241 on the stage 242 with an inclination of the angle θ, which may be smaller than 45 degrees, to the moving knife such that only an edge 241*a'* of the upper side 241*a* has contact with the moving knife 23 in the cross-section as shown in FIG. 12. The cutter unit 31 has line contact between the flat moving and stationary knives instead of an area contact in the prior art (in which θ=0°); as a result, a stress on the linear contact area between the flat moving and stationary knives is much less than that on the surface area contact of the prior art, and which improves cutting performance. Needless to say, the flat moving and stationary knives are easy to fabricate and less expensive. When the inclination of an angle θ was chosen about three degree (θ=3°), the cutting performance was improved considerably without an appreciable wear of the knife edges.

Figure 18:
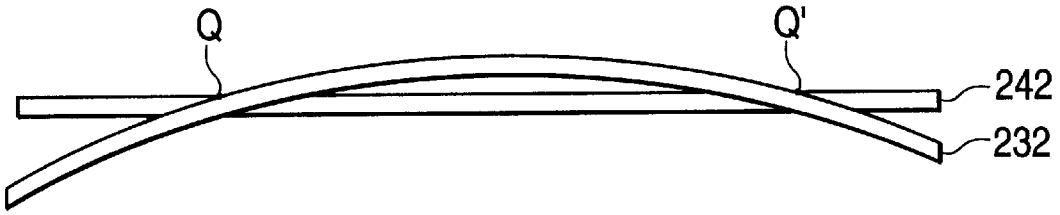
FIG. 18 is a schematic top view of a pair of convex moving and flat stationary knives of a fifth embodiment according to the present invention.
Figure 19:
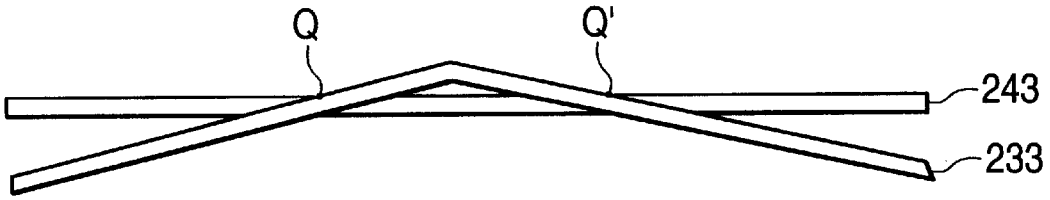
FIG. 19 is a schematic top view of a pair of V-shaped moving and flat stationary knives of a sixth embodiment according to the present invention.

If further improvement in cutting performance is desired, it can be done by providing a pair of moving and stationary knives one of which is bent against another when it is seen from the top position. For instance, FIG. 18 is a schematic top view of a pair of convex moving knife 232 and a flat stationary knife 242 with contact points Q, Q', while FIG. 19 is a schematic top view of a pair of V-shaped moving knife 233 and a flat stationary knife 243 with contact points Q, Q'. Curvature and bending angle of both the moving knives are exaggerated for illustration. In either case, the moving knife always keeps contact with the respective flat stationary knife only at symmetrical two points Q, Q' on the knife edges during the whole cutting process. In other words, the stress is always concentrated on the two points Q, Q' just at which the paper is cut. The cutting starts at both sides of a sheet of paper, then cutting points approach to each other, and finally the two points get together (i.e., connect, or join) at the central part when the paper is cut off completely.

Figure 13:
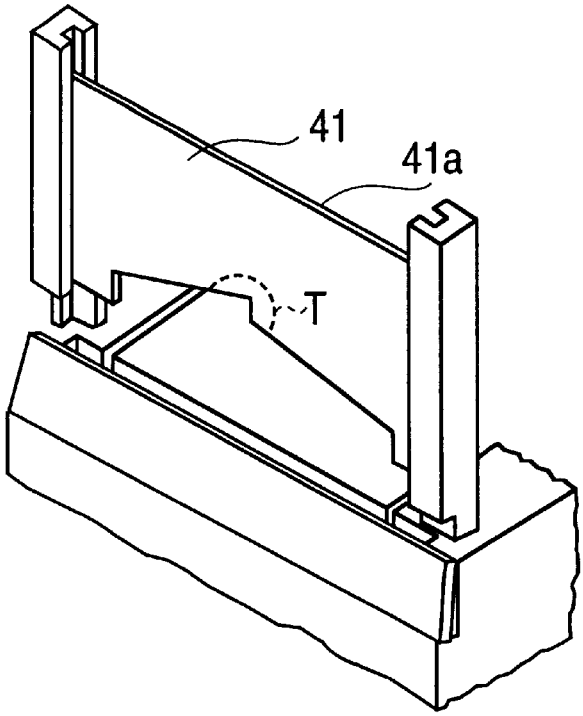
FIG. 13 is a perspective view of the main part of a sheet cutter for the third embodiment according to the present invention.
Figure 14:
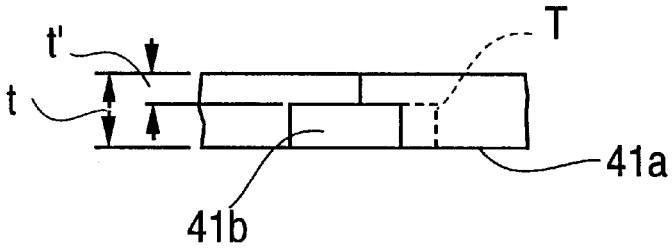
FIG. 14 is an enlarged bottom view of the center part of the moving knife of the sheet cutter shown in FIG. 13.
Figure 15:
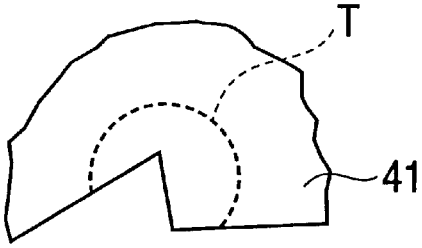
FIG. 15 is an enlarged front view of the center part of the moving knife of the sheet cutter shown in FIG. 13.

FIG. 13 is a perspective view of the main part of a sheet cutter of the third embodiment according to the present invention. FIGS. 14 and 15 are enlarged bottom and front views of the center part of the moving knife shown in FIG. 13.

The moving knife 41 has a recessed area on the back side 41*a* in the central region indicated by T. The recessed surface 41*b* is sunken, or recessed relatively to, from the back side 41*a* by depth of t—t' where t' and t are respective thicknesses of the central region indicated by T and that of the rest of the moving knife, respectively. The moving knife having the recessed area in the central region improves a cutting cross-section for full-cut case and makes a width of the uncut-region 15*b* narrower for the half-cut, thereby to leave a better appearance for the torn portion. As an example, when t and t' were chosen to be 0.8 mm and 0.3 mm, respectively, an appearance of the torn portion was remarkably improved without any degradation of mechanical strength in the moving knife.

Figure 16:
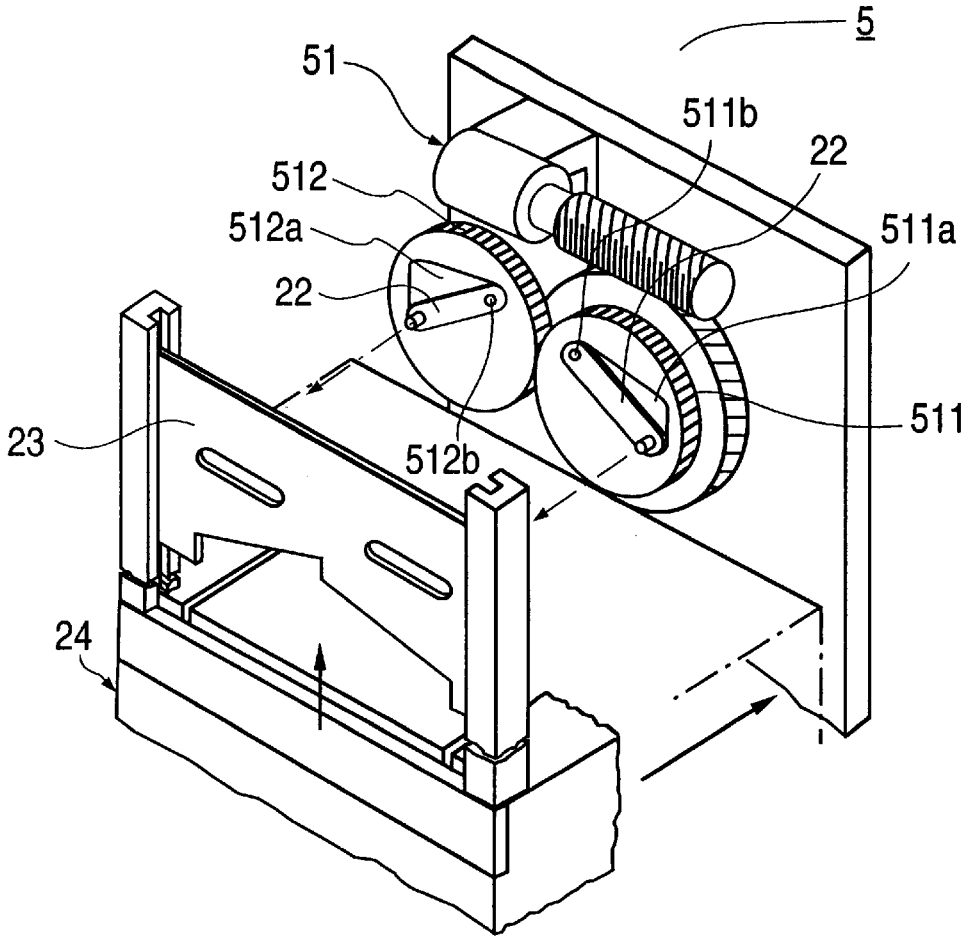
FIG. 16 is an exploded view of a main part of a sheet cutter of a fourth embodiment according to the present invention.
Figure 17:
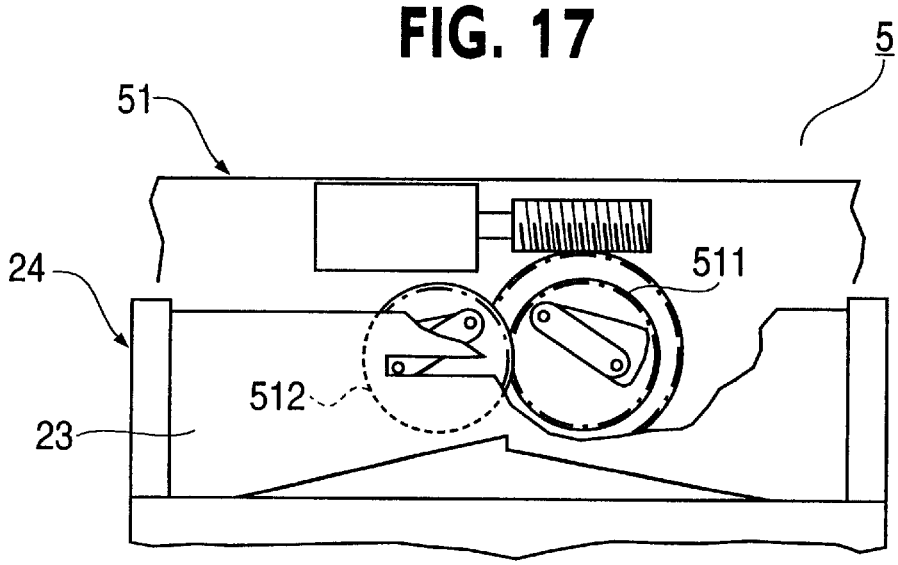
FIG. 17 is a front view of the main part of the sheet cutter shown in FIG. 16 to explain a half-cut operation.

FIGS. 16 and 17 are exploded, perspective and front views, respectively, of the main part of a sheet cutter 5 of a fourth embodiment according to the present invention.

The sheet cutters of the fourth embodiment comprises a driving unit 51 and a cutter unit 24. The former is essentially the same as the unit 21 of the first embodiment 2 shown in FIG. 7 except that a pair of the gear wheels 212, 215 with respective stoppers are replaced by a new pair of identical gear wheels 511, 512. Namely, the first gear wheel 511 has a sector-shaped groove 511*a* into which a link arm 22 is sunken, to undergo a pivotal motion around a pivot 511*b*, while the gear wheel 512 has a sector-shaped groove 512*a* into which a link arm 22 is sunken to undergo a pivotal motion around a pivot 512*b*. Both the link arms 22 are limited their pivotal motion within, the respective sector-shaped grooves. Particularly, each pair of side walls in the sector-shaped grooves acts as a pair of stoppers for the respective link arm 22. The resultant benefits of this embodiment are to save the space between the side wall and the cutter, and to simplify the manufacturing process of the cutter unit such that it is easier to make the gear wheel having a sector-shaped groove than that having a pair of stoppers such as 212$b_{-1}$, 212$b_{-2}$. These advantages provide a sheet cutter which is smaller and less expensive than that of the prior art.

What is claimed is:

1. A sheet cutter, comprising:

a driving unit including a rotatable member and a motor selectively producing rotation of the rotatable member;

a cutter unit comprising a moving knife and a stationary knife disposed in a retracted position with a gap therebetween for passage therethrough of a continuous sheet, and a pair of parallel guides arranged on respective, opposite sides of the moving knife along which the moving knife is movable in reciprocating motion against the stationary knife, the moving knife having a pair of slits thereon separated from each other and extending along a line perpendicular to a direction of the reciprocating motion of the moving knife; and a mechanical unit transforming the rotation of the rotating member into the reciprocating motion of the moving knife, the mechanical unit including a pair of identical rotatable gear wheels engaged with each other and arranged in a plane parallel to and opposing a plane of the moving knife, one of the rotatable gear wheels being rotated by the rotatable member of the driving unit, the pair of rotatable gear wheels having respective link arms disposed thereon at symmetrical positions relative to each other, each of the link arms having first and second ends, the first ends being connected to the respective rotatable gear wheels by corresponding pivots and the second ends having corresponding pins projecting therefrom perpendicularly to the planes of the gear wheels and the moving knife, and inserted into corresponding ones of the pair of slits on the moving knife for exerting a pair of forces on the moving knife, the link arms being rotatable within a limited angle on the respective rotatable gear wheels defining first and second opposing positions of the second ends.

2. A sheet cutter according to claim 1, wherein a distance, between the positions of the second ends, when the pair of forces is exerted thereby, changes during the reciprocating motion.

3. A sheet cutter according to claim 1, wherein all force components of the pair of forces, which are perpendicular to a direction of the reciprocating motion, substantially mutually cancel during the reciprocating motion.

4. A sheet cutter according to claim 1, wherein the pair of forces have respective, identical magnitudes in the direction of the reciprocating motion, during the reciprocating motion of the moving knife.

5. A sheet cutter according to claim 1, wherein one of the moving and stationary knives is in a flat plane and the other is on a curved surface and the one of the moving and stationary knives has a flat knife edge and the other has a knife edge inclined to the flat knife edge, such that cutting the continuous sheet proceeds both sides toward a center of the continuous sheet at two symmetrical points where the knife edge of the moving knife contacts the knife edge of the stationary knife.

6. A sheet cutter according to claim 1, wherein one of the moving and stationary knives has a flat knife edge and the other has a knife edge inclined to the flat knife edge and one of the moving and stationary knives is in a flat plane and the other is in two symmetrical planes, intersecting each other along an intersecting line perpendicular to the flat knife edge, such that cutting the continuous sheet proceeds from both sides toward a center of the continuous sheet at two symmetrical points where the knife edge of the moving knife contacts the knife edge of the stationary knife.

7. A sheet cutter according to claim 1, wherein one of the moving and stationary knives has a retrograde area in a central region of a knife edge on a back surface opposite to a front surface meeting with an opposing knife edge, such that a thickness of the retrograde area is thinner than that of regions of the knife.

8. A sheet cutter according to claim 7, wherein a portion of the life edge of the retrograde area has an inclination to the opposing knife edge.

9. A sheet cutter according to claim 1 wherein the moving and stationary knives are arranged in first and second planes, respectively, the first plane is generally perpendicular to a plane including a cutting area of a discharged part of the continuous sheet cut by the sheet cutter and the second plane is inclined to the first plane such that a knife edge of the stationary knife has contact with the moving knife in a line on a flat surface of the moving knife.

10. A sheet cutter according to claim 9, wherein the moving knife has a knife edge in the shape of an arch, in a lower side which is opposing to a line shaped knife edge of the stationary knife such that the continuous sheet is cut, proceeding from both sides thereof to a center of the continuous sheet at two symmetrical points where the knife edge of the moving knife contacts the knife edge of the stationary knife.

11. A sheet cutter according to claim 10, wherein one of the respective knife edges of the moving and stationary knives has a central region having a setback area such that a central region of the continuous sheet remains uncut in a cutting operation associated with a smaller amplitude of the reciprocating motion of the moving knife.

12. A sheet cutter according to claim 11, wherein a portion of the one of the respective knife edges of the moving and stationary knives, corresponding to the setback area, includes an inclination opposing the other knife edge.

13. A sheet cutter according to claim 12, wherein the knife edges of the moving and stationary knives respectively have a central region with setback area and a flat knife edge, and the knife edge of the setback area is inclined to the flat knife edge of the stationary knife.

14. A sheet cutter according to claim 1, wherein the first and second opposing positions of the second ends of the link arms on the respective gear wheels are spaced apart from each other by respective, first and second different distances from a center of the respective gear wheels.

15. A sheet cuter according to claim 14, further comprising first and second stoppers arranged on each of the rotatable gear wheels at the first and second opposing positions thereof, respectively, for engaging opposite sides of the respective link arms and thereby defining the limited angle of rotation thereof and such that each of the link arms is restricted in rotation to the first opposing position during a corresponding, first direction of rotation of the respective rotatable gear wheel and to the second opposing position during a corresponding, second and opposite direction of rotation of the respective rotatable gear wheel.

16. A sheet cutter according to claim 15, wherein each link arm is embedded in a recessed well on the respective rotatable gear wheel such that a pair of first and second spaced side walls of the recessed well act as respective first and second stoppers at the first and second opposing positions of the second end of the link arm.

17. A sheet cutter according to claim 14, wherein the one of the first and second opposing positions, having a longer distance from the center of the respective rotatable gear wheel, results in a larger amplitude of the reciprocating motion of the moving knife while the other one of the first and second opposing positions, having a shorter distance from the center of the respective rotatable gear wheel, results in a smaller amplitude of the reciprocating motion of the moving knife.

18. A sheet cutter according to claim 17, wherein the larger amplitude of the reciprocating motion of the moving knife associated with a first direction of the rotating member in the driving unit is adjusted to cut a part of the continuous sheet off completely, for discharge, while the smaller amplitude of the reciprocating motion of the moving knife associated with a second and opposite direction of the rotating member in the driving unit is adjusted to cut a part of the continuous sheet incompletely, such that the cut part of the continuous sheet remains connected to the continuous sheet which remains in the sheet cutter.

19. A sheet cuter according to claim 6, further comprising first and second stoppers arranged on each of the rotatable gear wheels at the first and second opposing positions, respectively, for engaging opposite sides of the respective link arms and thereby defining the limited angle of rotation thereof and such that each of the link arms is restricted in rotation to the first of the two opposing positions during a corresponding, first direction of rotation of the respective rotatable gear wheel and to the second of the two opposing positions during a corresponding, second and opposite direction of rotation of the respective rotatable gear wheel.

20. A sheet cutter, comprising:

a cutter unit comprising a stationary knife and a moving knife defining a cutting plane therebetween and movable relatively to each other in a reciprocating motion in a first direction, in the cutting plane, between spaced positions defining a gap therebetween through which a continuous sheet extends in a second direction, transverse to the cutting plane, and engaged positions for selectively cutting the continuous sheet along a cut line in the cutting plane, substantially transverse to a length of the continuous sheet and to the second direction; and a driving unit having a pair of links which are switchable between different, first and second positions, the driving unit transforming circular motion of a rotatable drive member into driving forces of equal magnitude in the first direction which are coupled from the driving member by the pair of links and exerted thereby on a pair of respective, first and second driving points of the moving knife located substantially symmetrically with respect to a line parallel to the first direction and extending perpendicularly to, and through a center of, a line connecting the first and second driving points, for moving the moving knife in the reciprocating motion in the cutting plane and selectively driving the moving knife in the reciprocating motion by first and second, different distances between the spaced and engaged positions thereof relatively to the stationary knife, the first distance being established by circular motion of the rotatable drive member in a first of clockwise and counterclockwise directions which switches the pair of links to the first positions thereof and the second, different distance being established by circular motion of the rotatable drive member in the other of clockwise and counterclockwise directions which switches the pair of links to the second positions thereof.

21. A sheet cutter, comprising:

a cutter unit comprising a stationary knife and a moving knife defining a cutting plane therebetween and movable relatively to each other in a reciprocating motion in a first direction, in the cutting plane, between spaced positions defining a gap therebetween through which a continuous sheet extends in a second direction, transverse to the cutting plane, and engaged positions for selectively cutting the continuous sheet along a cut line in the cutting plane, substantially transverse to a length of the continuous sheet and to the second direction; and a driving unit having a pair of links which are switchable between different, first and second positions, producing a pair of first and second driving forces which are coupled from the driving member by the pair of links and exerted thereby on a pair of respective, first and second driving points of the moving knife located substantially symmetrically with respect to a line parallel to the first direction and extending perpendicularly to, and through a center of, a line connecting the first and second driving points, for moving the moving knife in the reciprocating motion in the cutting plane and driving the moving knife in the reciprocating motion by first and second, different distances between the spaced and the engaged positions thereof relatively to the stationary knife, the first distance being established by circular motion, through a complete rotation, of the rotatable drive member in a first of clockwise and counterclockwise directions which switches the links to the first positions thereof and the second, different distance being established by circular motion, through a complete rotation, of the rotatable drive member in the other of clockwise and counterclockwise directions which switches the links to the second positions thereof.

22. A sheet cutter, comprising:

a cutter unit comprising a stationary knife and a moving knife defining a cutting plane therebetween and movable relatively to each other in a reciprocating motion in a first direction, in the cutting plane, between spaced positions defining a gap therebetween through which a continuous sheet extends in a second direction, transverse to the cutting plane, and engaged positions for selectively cutting the continuous sheet along a cut line in the cutting plane, substantially transverse to a length of the continuous sheet and to the second direction; and a driving unit producing a pair of fist and second driving forces exerted on a pair of respective, first and second driving points of the moving knife located substantially symmetrically with respect to a line parallel to the first direction and extending perpendicularly to, and through a center of, a line connecting the first and second driving points, for moving the moving knife in the reciprocating motion in the cutting plane and driving the moving knife in the reciprocating motion by first and second, different distances between the spaced and the engaged positions thereof relatively to the stationary knife, the driving unit comprising a pair of gears mounted in a plane parallel to the cutting plane and for rotation, in engaged relationship, about respective axes parallel to each other and perpendicular to the first direction, the driving unit selectively driving the pair of gears in a first sense of rotation thereof and, alternatively, in a second sense of rotation thereof and the gears being selectively coupled to the pair of respective first and second driving points of the moving knife from respective first positions on the gears at a common first radial distance from the respective axes thereof in the first sense of rotation thereof and from respective second positions on the gears at a common second radial distance from the respective axes thereof in the second sense of rotation thereof for driving the moving knife in the reciprocating motion respectively by first and second, different distances between the spaced and the engaged positions thereof relatively to the stationary knife.

23. A sheet cutter, comprising:

a cutter unit comprising a stationary knife and a moving knife defining a cutting plane therebetween and movable relatively to each other in a reciprocating motion in a first direction, in the cutting plane, between spaced positions defining a gap therebetween through which a continuous sheet extends in a second direction, transverse to the cutting plane, and engaged positions for selectively cutting the continuous sheet along a cut line in the cutting plane, substantially transverse to a length of the continuous sheet and to the second direction; and a driving unit having a pair of links mounted on respective rotatable driving elements and which are switchable between first and second positions in accordance with first and second opposite directions of rotation, respectively, of the respective rotatable driving elements, the driving unit producing a pair of first and second driving forces which are coupled from the respective rotatable driving elements through the pair of links and exerted thereby on a pair of respective, first and second driving points of the moving knife located substantially symmetrically with respect to a line parallel to the first direction and extending perpendicularly to, and through a center of, a line connecting the first and second driving points, for moving the moving knife in the reciprocating motion in the cutting plane and driving the moving knife in the reciprocating motion, in accordance with switching the links selectively to the first and second positions thereof, by first and second, different distances between the spaced and the engaged positions thereof relatively to the stationary knife, wherein the stationary and moving knives have respective cutting edges, the cutting edge of one of the first and second knives having a portion which is set back so as not to cut the continuous sheet completely, along the cut line, when the moving knife is driven in the reciprocating motion by the first distance but so as to cut the continuous sheet completely, along the cut line, when the moving knife is driven in the reciprocating motion by the second distance.

24. A sheet cutter according to claim 23, wherein a size of the set back portion, in the first direction from the cutting edge, is less than the difference between the first and second distances of reciprocating motion in the first direction of the moving knife.

25. A sheet cutter, comprising:

a cutter unit comprising a stationary knife and a moving knife defining a cutting plane therebetween and movable relatively to each other in a reciprocating motion in a first direction, in the cutting plane, between spaced positions defining a gap therebetween through which a continuous sheet extends in a second direction, transverse to the cutting plane, and engaged positions for selectively cutting the continuous sheet along a cut line in the cutting plane, substantially transverse to a length of the continuous sheet and to the second direction; and a driving unit transforming circular motion of a rotatable drive member into driving forces of equal magnitude in the first direction, exerted on a pair of respective, first and second driving points of the moving knife located substantially symmetrically with respect to a line parallel to the first direction and extending perpendicularly to, and through a center of, a line connecting the first and second driving points, for moving the moving knife in the reciprocating motion in the cutting plane and selectively driving the moving knife in the reciprocating motion by first and second, different distances between the spaced and engaged positions thereof relatively to the stationary knife, the driving unit comprising a pair of gears mounted in a plane parallel to the cutting plane and for rotation, in engaged relationship, about respective axes parallel to each other and perpendicular to the first direction, the gears being selectively coupled to the pair of respective first and second driving points of the moving knife from respective first positions on the gears at a common first radial distance from the respective axes thereof in a first sense of rotation thereof and from respective second positions on the gears at a common second radial distance from the respective axes thereof in a second sense of rotation thereof for driving the moving knife in the reciprocating motion respectively by the first and second, different distances between the spaced and the engaged positions thereof relatively to the stationary knife.

26. A sheet cutter according to claim 25, wherein the stationary and moving knives have respective cutting edges, the cutting edge of one of the stationary and moving knives having a portion which is set back so as not to cut the continuous sheet completely, along the cut line, when the moving knife is driven in the reciprocating motion by the first distance but so as to cut the continuous sheet completely, along the cut line, when the moving knife is driven in the reciprocating motion by the second distance.

27. A sheet cutter according to claim 26, wherein a size of the set back portion, in the first direction from the cutting edge, is less than the difference between the first and second distances of reciprocating motion in the first direction of the moving knife.

28. A sheet cutter, comprising:

a cutter unit comprising a stationary knife and a moving knife defining a cutting plane therebetween and movable relatively to each other in a reciprocating motion in a first direction, in the cutting plane, between spaced positions defining a gap therebetween through which a continuous sheet extends in a second direction, transverse to the cutting plane, and engaged positions for selectively cutting the continuous sheet along a cut line in the cutting plane, substantially transverse to a length of the continuous sheet and to the second direction; and a driving unit transforming circular motion of a rotatable drive member into driving forces of equal magnitude in the first direction, exerted on a pair of respective, first and second driving points of the moving knife located substantially symmetrically with respect to a line parallel to the first direction and extending perpendicularly to, and through a center of, a line connecting the first and second driving points, for moving the moving knife in the reciprocating motion in the cutting plane and selectively driving the moving knife in the reciprocating motion by first and second, different distances between the spaced and engaged positions thereof relatively to the stationary knife, the driving unit comprising a pair of first and second gears mounted for rotation in engaged relationship in a mounting plane parallel to the cutting plane and about respective axes extending in parallel to each other and perpendicular to the first direction, and having a pair of respective, symmetrically disposed first and second links thereon, the links having first and second ends and being rotatably mounted at the first ends thereof on respective first and second pivots on the respective gears, so as to dispose the second, free ends thereof at respective and different, first and second radial distances from the axes of the respective gears in accordance with first and second, opposite directions of rotation of each of the gears, the second, free ends of the first and second links being coupled to the symmetrical, first and second driving points on the moving knife, rotation of the first and second gears in a first sense rotating the respective first and second links so as to position the second ends thereof at the first radial distances and thereby driving the moving knife in the reciprocating motion in the first direction by a first distance and rotation of the first and second gears in a second, opposite sense rotating the links so as to position the second ends thereof at the second radial positions and thereby driving the moving knife in the reciprocating motion in the first direction by a second distance, greater than the first distance.

29. A sheet cutter according to claim 28, wherein the stationary and moving knives have respective cutting edges, the cutting edge of one of the stationary and moving knives having a portion which is set back so as not to cut the continuous sheet, completely, along the cut line, when the moving knife is driven in the reciprocating motion by the first distance but so as to cut the continuous sheet completely, among the cut line, when the moving blade is driven in the reciprocating motion by the second distance.

30. A sheet cutter according to claim 29, wherein a size of the set back portion, in the first direction from the cutting edge, is less than the difference between the first and second distances of reciprocating motion in the first direction of the moving knife.

31. A sheet cutter, comprising:

a cutter unit comprising a stationary knife and a moving knife defining a cutting plane therebetween and movable relatively to each other in a reciprocating motion in a first direction, in the cutting plane, between spaced positions defining a gap therebetween through which a continuous sheet extends in a second direction, transverse to the cutting plane, and engaged positions for selectively cutting the continuous sheet along a cut line in the cutting plane, substantially transverse to a length of the continuous sheet and to the second direction; and a driving unit producing a pair of first and second driving forces exerted on a pair of respective, first and second driving points of the moving knife located substantially symmetrically with respect to a line parallel to the first direction and extending perpendicularly to, and through a center of, a line connecting the first and second driving points, for moving the moving knife in the reciprocating motion in the cutting plane and driving the moving knife in the reciprocating motion by first and second, different distances between the spaced and the engaged positions thereof relatively to the stationary knife, wherein the driving unit comprises a pair of first and second gears mounted for rotation in engaged relationship in a mounting plane parallel to the cutting plane and about respective axes extending in parallel, both to each other and perpendicular to the first direction, and having a pair of respective, symmetrically disposed first and second links thereon, the having first and second ends and being rotatably mounted at the first ends thereof on respective first and second pivots on the respective gears, so as to dispose the second, free ends thereof at respective and different, first and second radial distances from the axes of the respective gears in accordance with first and second, opposite directions of rotation of each of the gears, the second, free ends of the first and second links being coupled to the symmetrical, first and second driving points on the moving knife, rotation of the first and second gears in a first sense rotating the respective first and second links so as to position the second ends thereof at the first radial distances and thereby driving the moving knife in the reciprocating motion in the first direction by a first distance and rotation of the first and second gears in a second, opposite sense rotating the links so as to position the second ends thereof at the second radial positions and thereby driving the moving knife in the reciprocating motion in the first direction by a second distance, greater than the first distance.

32. A sheet cutter according to claim 31, wherein the stationary and moving knives have respective cutting edges, the cutting edge of one of the stationary and moving knives having a portion which is set back so as not to cut the continuous sheet, completely, along the cut line, when the moving knife is driven in the reciprocating motion by the first distance but so as to cut the continuous sheet completely, among the cut line, when the moving blade is driven in the reciprocating motion by the second distance.

33. A sheet cutter according to claim 32, wherein a size of the set back portion, in the first direction from the cutting edge, is less than the difference between the first and second distances of reciprocating motion in the first direction of the moving knife.

* * * * *

UNITED STATES PATENT AND TRADEMARK OFFICE

CERTIFICATE OF CORRECTION

PATENT NO.: 6,109,154
DATED : August 29, 2000
INVENTOR(S): Keiji MIYATSU et al.

It is certified that error appears in the above-identified patent and that said Letters Patent is hereby corrected as shown below:

Col. 8, line 53, after "of" (second occurrence) insert --other--;
line 56, change "life" to --knife--.

Col. 14, line 40, after "the" insert --links--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*